US012180816B2

(12) United States Patent
Fortin et al.

(10) Patent No.: US 12,180,816 B2
(45) Date of Patent: Dec. 31, 2024

(54) AUTOMATED DETECTION OF FRACKING END STAGES FOR ACTIVATION OF SWITCHOVER VALVES DURING COMPLETION OPERATIONS

(71) Applicant: Cold Bore Technology Inc., Calgary (CA)

(72) Inventors: Alexandre Fortin, Calgary (CA); Khaled Behairy, Calgary (CA); Cooper Gradishar, Calgary (CA)

(73) Assignee: ColdBore Technology Inc., Calgary (CA)

( * ) Notice: Subject to any disclaimer, the term of this patent is extended or adjusted under 35 U.S.C. 154(b) by 0 days.

(21) Appl. No.: 17/883,529

(22) Filed: Aug. 8, 2022

(65) Prior Publication Data

US 2023/0050904 A1 Feb. 16, 2023

Related U.S. Application Data

(60) Provisional application No. 63/231,175, filed on Aug. 9, 2021.

(51) Int. Cl.
*E21B 43/26* (2006.01)
*E21B 47/007* (2012.01)

(52) U.S. Cl.
CPC ..... *E21B 43/2607* (2020.05); *E21B 47/007* (2020.05); *E21B 2200/20* (2020.05)

(58) Field of Classification Search
None
See application file for complete search history.

(56) References Cited

U.S. PATENT DOCUMENTS

| | | | | |
|---|---|---|---|---|
| 6,980,940 | B1 | 12/2005 | Gurpinar et al. | |
| 10,415,348 | B2 * | 9/2019 | Zhang | E21B 43/2607 |
| 10,487,651 | B2 * | 11/2019 | Dursun | E21B 49/08 |
| 10,711,576 | B2 * | 7/2020 | Bishop | E21B 7/022 |
| 11,022,526 | B1 * | 6/2021 | Yeung | F04B 17/05 |

(Continued)

FOREIGN PATENT DOCUMENTS

| | | | |
|---|---|---|---|
| CA | 2980549 | A1 | 9/2016 |
| CA | 2858100 | C | 10/2018 |
| GB | 2429797 | B | 9/2010 |

OTHER PUBLICATIONS

Haustveit et al., "Monitoring the Pulse of a Well through Sealed Wellbore Pressure Monitoring, a Breakthrough Diagnostic with a Multi-Basin Case Study", Society of Petroleum Engineers, SPE-199731-MS, Feb. 2020.

*Primary Examiner* — Kenneth L Thompson
(74) *Attorney, Agent, or Firm* — Todd A. Rattray; Oyen Wiggs Green & MutalaLLP

(57) ABSTRACT

A method for determining an end-of-stage (EoS) state indication of a fracking operation occurring at a fracking site comprises: receiving an end-of-stage (EoS) detection model; receiving wellsite activity data; determining a positive activity data health indication in relation to the wellsite activity data using the EoS detection model; determining an idle activity indication from the wellsite activity data using the EoS detection model; receiving wellsite stage data; determining a positive stage data health indication in relation to the wellsite stage data based on the EoS detection model; and determining a positive EoS state indication from the wellsite stage data using the EoS detection model.

6 Claims, 11 Drawing Sheets

(56) References Cited

U.S. PATENT DOCUMENTS

| | | | | |
|---|---|---|---|---|
| 2006/0102346 | A1 | 5/2006 | Casey | |
| 2022/0027538 | A1* | 1/2022 | Walters | G06F 30/28 |
| 2022/0112796 | A1* | 4/2022 | Jaaskelainen | E21B 43/26 |

* cited by examiner

AUTOMATED DETECTION OF FRACKING END STAGES FOR ACTIVATION OF SWITCHOVER VALVES DURING COMPLETION OPERATIONS

REFERENCE TO RELATED APPLICATIONS

This application claims priority from, and for the purposes of the United States the benefit under 35 USC 119 in connection with, U.S. application No. 63/231,175 filed 9 Aug. 2022, which is hereby incorporated herein by reference.

TECHNICAL FIELD

The present disclosure relates to systems and methods for monitoring the status of wellsite operations. More particularly, the present disclosure relates to systems and methods for detecting and signalling fracking end stages during completion operations.

BACKGROUND

During oil-well completion operations (completions) such as hydraulic fracturing (fracking), a series of operations are conducted on the well. Tools must be deployed within the well, used, and removed. Fluids and entrained solids from various systems may be pumped down the well, and various related fluids allowed to flow out at stages during the completion. Completions can be demanding in both time and attention. Completions can take multiple weeks of long hours to complete. The intensive nature of the work can mean that individuals may tire or lose focus. Errors or problems in an oil well completions process can cause expensive delays and/or accidents risking injuries to personnel and damage to equipment. Oil-well completions are also expensive processes due to the extensive combination of equipment, materials and personnel required. Each additional day of operation may add significant costs.

A typical fracking wellsite comprises multiple wells, each of which must be individually completed. To hydraulically fracture (f rack) each well, fracking fluid comprising water, sand, and other chemicals is typically pumped at a high pressure down each well in turn. Various parties are typically responsible for different parts of a fracking operation. For example, a fracturing tree company may be responsible for operating wellsite equipment, such as wellhead valves and switchover valves, which together determine to which well at the wellsite the fracking fluid is directed.

Each well at the wellsite is typically f racked in turn. Accordingly, the fracturing tree company directs the fracking fluid towards a well until the well is f racked, and then operates the wellsite equipment to redirect the fracking fluid to another well. As such, the fracturing tree company must be notified when fracking of a well is complete. Furthermore, due in part to the high pressure of the fracking fluid during a fracking operation, the fracturing tree company must only operate the wellsite equipment to redirect the fracking fluid once fracking of a well is complete and the pressure of the fracking fluid in the completed well is reduced. The fracking of a single well is referred to as a "stage", and the end of fracking of a single well is referred to as an "end-of-stage" or EoS.

When fracking multiple wells at a wellsite, there is a desire that completion operations proceed orderly between wells to maintain the cost of operating the wellsite at an economically viable level. In particular, there is a desire for the fracking companies and fracturing tree companies to communicate at the end of every stage, so that the fracturing tree company can actuate the switchover valve to be ready to start the next stage on the next well. This switchover valve actuation is also desirably done only after the fracking company has significantly reduced the pressure of fluid directed towards a well to protect the equipment as well as workers on site.

Existing systems of monitoring completions may involve several personnel manually measuring and/or reviewing the operational status of several systems or pieces of equipment. These measurements and/or monitoring observations are collected and checked against expectations for the given stage of the completions operation. These measurements and/or monitoring observations may be subject to errors in classification and timestamping, and may be subject to inconsistencies between individual field personnel. More errors may be introduced later in a completion operation as the attention and energy of the personnel wanes.

Accurate, efficient and comprehensive monitoring of completion operations can provide improvements in speed and efficiency by indicating that a given stage is complete and improving communication of that data. Additionally, when unexpected conditions or events occur on the site, accurate and prompt status updates may assist in restoring the operation.

There are typically no technological connections between the different companies working on fracking operations. Such companies typically relay verbal communications, either face-to-face or over a radio channel. This verbal communication creates situations where delay in communications, miscommunication or lack of communication can significantly slow down operations at significant cost to the operator of the site.

There is a general desire for improved systems and methods for monitoring well site completions.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a method for determining an end-of-stage (EoS) state indication of a fracking operation occurring at a fracking site. The method comprises: receiving an end-of-stage (EoS) detection model; receiving wellsite activity data; determining a positive activity data health indication in relation to the wellsite activity data using the EoS detection model; determining an idle activity indication from the wellsite activity data using the EoS detection model; receiving wellsite stage data; determining a positive stage data health indication in relation to the wellsite stage data based on the EoS detection model; and determining a positive EoS state indication from the wellsite stage data using the EoS detection model.

The wellsite activity data may comprise a plurality of activity records. The EoS detection model may comprise an activity classification model and an activity health model.

Determining the positive activity data health indication may comprise: classifying each of the activity records as a primary record, a secondary record, or a tertiary record using the activity classification model; for each of the primary records, determining a positive activity health using the activity health model; and, for each of the secondary records, determining a positive activity health using the activity health model.

The wellsite activity data may comprise a plurality of activity records. The EoS detection model may comprise an activity classification model and an activity health model. Determining the positive activity data health indication may comprise: classifying each of the activity records as a primary record, a secondary record, or a tertiary record using the activity classification model; for each of the primary records, determining a positive activity health using the activity health model; for at least one of the secondary records, determining a negative activity health using the activity health model; for at least one of the tertiary records, determining a positive activity health using the activity health model; and, for each of the secondary records with a determined negative activity health, determining one or more replacement tertiary records with a positive activity health using the activity health model.

The EoS detection model may comprise an activity detection model. Determining the idle activity indication may comprise: for each of the primary records, determining an idle activity using the activity detection model; for each of the healthy secondary records, determining an idle activity using the activity detection model; and, for any replacement tertiary records, determining an idle activity using the activity detection model.

The wellsite stage data may comprise a plurality of stage records. The EoS detection model may comprise a stage health model. Determining a positive stage data health indication may comprise, for each of the stage records, determining a positive stage health using the stage health model.

The EoS detection model may comprise an EoS model. Determining a positive EoS state indication may comprise, for each of the stage records, determining a positive EoS state using the EoS model.

Another aspect of the invention provides a system for operating a fracking site switchover valve. The system comprises: a switchover valve controller; and a computer system communicatively coupled to the switchover valve controller, wherein the computer system is configured to: determine an end-of-stage (EoS) indication according to any of the methods described herein; and operate the switchover valve based at least in part on the EoS indication.

Another aspect of the invention provides a method for switching a switchover valve between fracking wells. The method comprises: determining an end-of-stage (EoS) indication according to the methods described herein; and switching the switchover valve from a first well to a second well based at least in part on the EoS indication.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The present invention is directed methods and systems for detecting an end of a fracking stage of an oil and/or gas well at a wellsite. Some embodiments may comprise generating an end-of-stage (EoS) state indication, wherein the EoS state indication indicates the state of the fracking operation of a well of the wellsite. For example, the EoS state indication may indicate one or more of the following well states:

active, not EoS;
inactive, not EoS;
inactive, EoS; and
indefinite.

In some embodiments, the EoS state indication may be used in wellsite operations, for example to operate a switchover valve.

Figure 1:
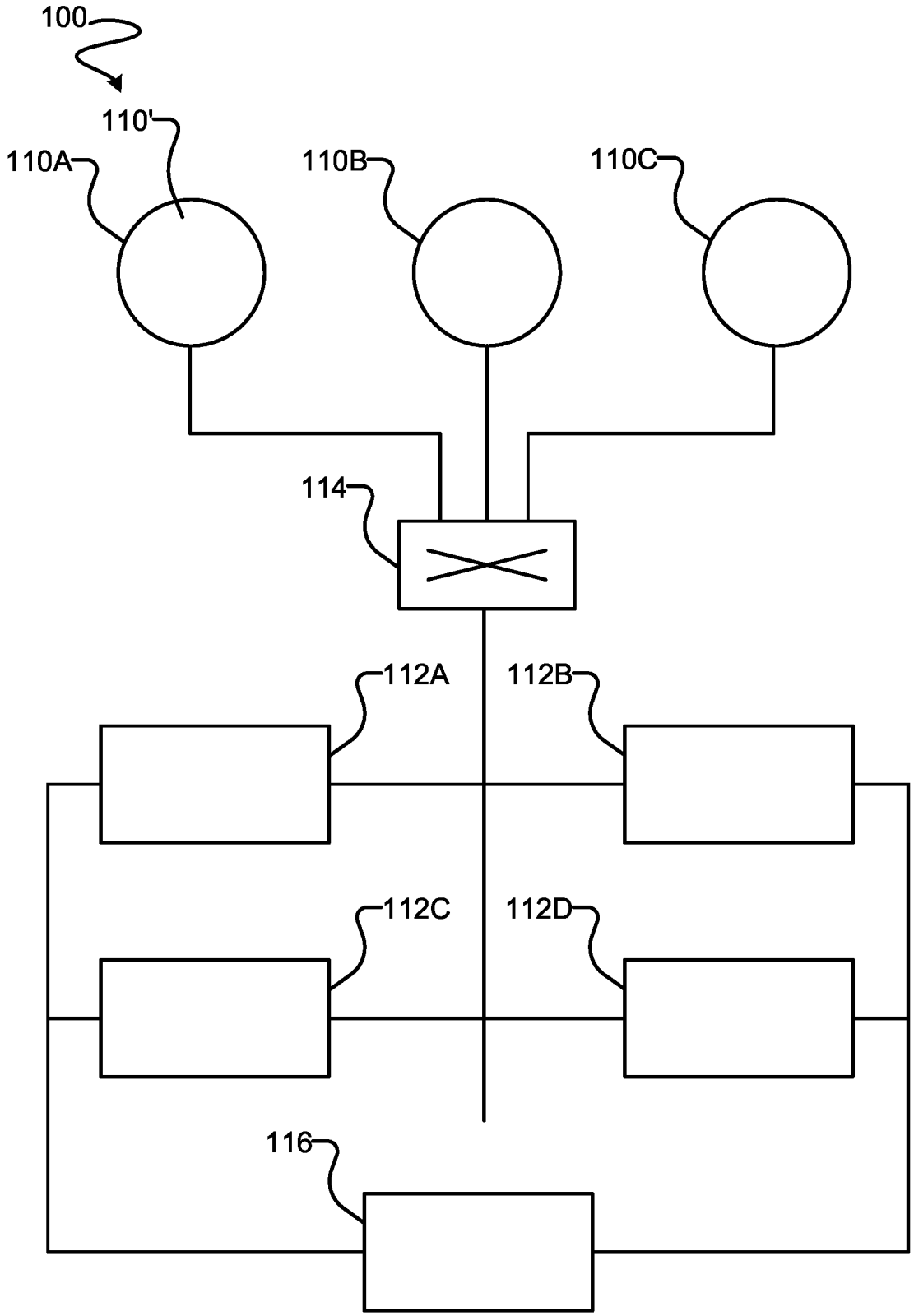
FIG. 1 is a schematic diagram of an example fracking wellsite according to a particular example embodiment.

FIG. 1 is a schematic diagram of an example fracking wellsite 100 according to a particular example embodiment. Fracking wellsite 100 comprises wells 110A, 110B and 110C (collectively, wells 110) and pumps 112A, 112B, 112C and 112D (collectively, pumps 112). Wells 110 are connected to pumps 112 by switchover valve 114. Switchover valve 114 directs an output of pumps 112 to one of wells 110. Wellsite 100 further comprises turbine 116 that powers pumps 112. FIG. 1 depicts an embodiment of fracking wellsite 100 comprising three wells 110 and four pumps 112. However, fracking wellsite 100 may generally comprise any number of wells 110 and pumps 112.

During a fracking operation, turbine 116 supplies pumps 112 with fracking fluid. Fracking fluid comprises water and one or more proppants, for example sand. Pumps 112 pressurize the fracking fluid, and switchover valve 114 directs the high-pressure fracking fluid from pumps 112 to a particular well 110' from among wells 110. The high-pressure fracking fluid flows from pumps 112, through switchover valve 114 and down well 110'. The high-pressure fracking fluid flows from well 110' into a surrounding oil/gas formation and fractures the formation.

High pressure (e.g. over 10,000 psi) fracking fluid is typically required to effectively hydraulically fracture an oil/gas formation. Accordingly, it is desirable that switchover valve 114 not be operated while high pressure fracking fluid is flowing from pumps 112 through switchover valve 114 and down well 110'. Attempting to operate switchover valve 114 while the fracking fluid is pressurized may result in damage to equipment and/or injury to personnel.

To safely and effectively operate switchover valve 114, the pressure of the fracking fluid through switchover valve 114 should first be reduced. Furthermore, switchover valve 114 should only be operated once fracking of the formation surrounding well 110' is complete; i.e. at the end of the fracking stage.

Figure 2A:
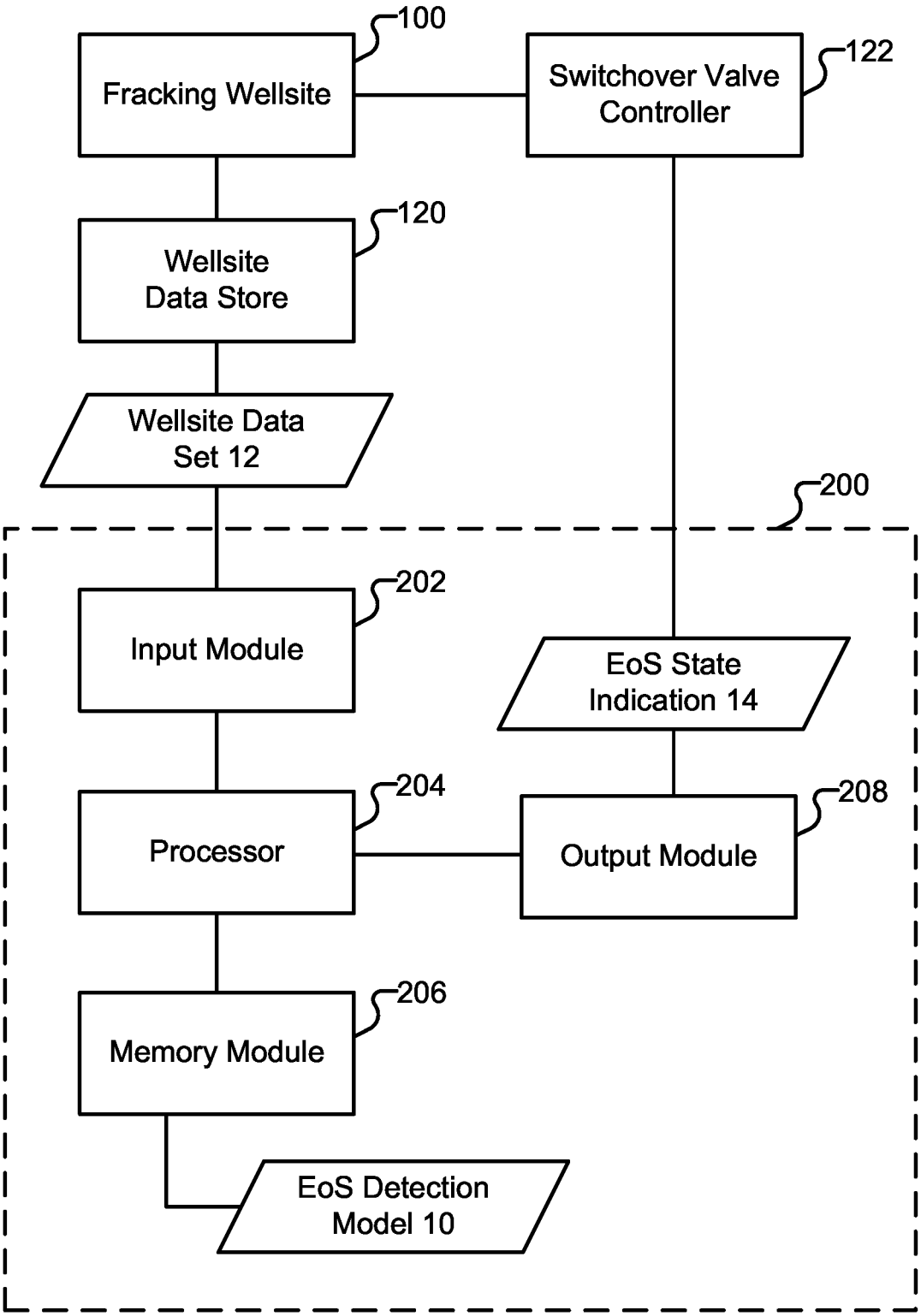
FIG. 2A is a schematic diagram of a system for automated detection of a fracking end stage and activation of one or more switchover valves according to a particular embodiment.

FIG. 2A is a schematic diagram of system 200 for automated detection of a fracking end stage and activation of one or more switchover valves according to a particular embodiment.

System 200 is configured to receive wellsite data set 12 from wellsite data store 120 and generate end-of-stage (EoS) state indication 14. EoS state indication 14 may be communicated to switchover valve controller 122, wherein switchover valve controller 122 controls switchover valve 114.

Wellsite data store 120 stores data representing various operations of fracking wellsite 100. For example, data store 120 may contain data representing one or more of:

- a rate of fracking fluid flow through one or more of pumps 112;
- a pressure of fracking fluid exiting one or more of pumps 112;
- a power of turbine 116;
- an amount of fracking fluid pumped by pumps 112;
- a clean rate;
- a slurry rate;
- a fracking water reservoir level;
- a fracking proppant reservoir level; and
- a fracking additive reservoir level.

System 200 comprises input module 202, processor 204, memory module 206, and output module 208. Input module 202, processor 204, memory module 206, and output module 208 may be communicatively coupled. Memory module 206 contains one or more data models, for example end-of-stage (EoS) detection model 10.

In the illustrated embodiment, input module 202 is communicatively coupled to data store 120. In some embodiments, input module 202 is communicatively coupled to data store 120 by a local area network or the internet. In some embodiments, input module 202 is communicatively coupled to data store 120 using some other suitable protocol to minimize exposure of system 200 to the internet.

Processor 204 may be configured to:

- receive, via input module 202, wellsite data set 12 from wellsite data store 120;
- retrieve, via memory module 206, EoS detection model 10;
- execute EoS detection model 10 to generate EoS state indication 14; and
- output, via output module 208, EoS state indication 14.

In some embodiments, processor 204 may be configured to output, via output module 208, EoS state indication 14 to switchover valve controller 122. Switchover valve controller 122 may be configured to operate a switchover valve (e.g. switchover valve 114 of wellsite 100) in part based on EoS state indication 14.

Figure 2B:
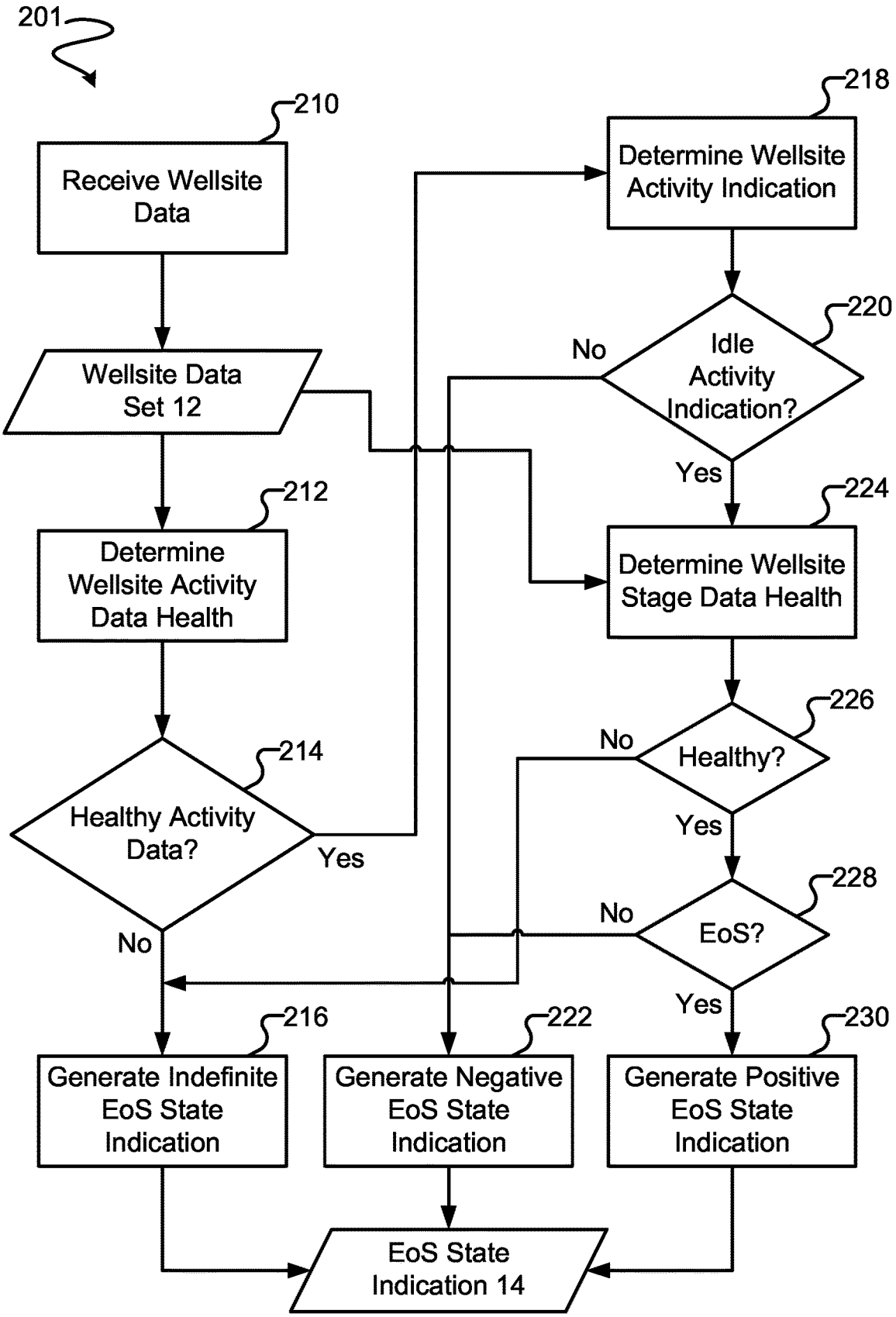
FIG. 2B is a schematic diagram of a method for automated detection of a fracking end stage and generation of an EoS state indication according to a particular embodiment.

FIG. 2B is a schematic diagram of method 201 for automated detection of a fracking end stage and generation of EoS state indication 14 according to a particular embodiment. In some embodiments, method 201 may be performed by system 200. In some embodiments, memory module 206 may store computer readable instructions that when executed by processor 204 cause system 200 to perform method 201.

Step 210 of method 201 comprises receiving (or otherwise obtaining) wellsite data set 12. Wellsite data set 12 may comprise all data in wellsite data store 120, or a subset of the data in wellsite data store 120. Where wellsite data set 12 comprises a subset of data in wellsite data store 120, step 210 may further comprise selecting the subset of data in wellsite data store 120.

In the illustrated embodiment, wellsite data set 12 comprises wellsite activity data 12A and wellsite stage data 12B. As is described in more detail below, wellsite activity data 12A may be used by method 201 to determine an activity indication of wellsite 100 (either idle or active), and wellsite stage data 12B may be used by method 201 to determine an end-of-stage indication (either positive indicating a fracking end stage, or negative indicating not a fracking end stage) of wellsite 100.

Step 212 of method 201 comprises determining a data health of wellsite activity data 12A. Step 212 may comprise generating an activity data health indication, wherein the activity data health indication indicates the health (or lack of health) of wellsite activity data 12A. A particular embodiment of the step 212 wellsite activity data health check is described in more detail below.

Method 201 then proceeds to step 214 which comprises: querying the step 212 activity data health indication; and if the step 212 activity data health indication indicates unhealthy wellsite activity data 12A (i.e. a negative activity data health indication), proceeding to step 216. Step 216 comprises generating an indefinite EoS state indication 14, and the end of method 201.

If the step 212 activity data health indication indicates healthy data (i.e. a positive activity data health indication), method 201 proceeds from step 214 to step 218 which involves determining an activity indication of wellsite 100.

Step 218 may comprise generating an activity indication, wherein the activity indication indicates an active or idle state of wellsite 100. A particular embodiment of the step 218 determination of the activity indication is described in more detail below.

Method 201 then proceeds to step 220 which comprises: querying the step 218 activity indication; and if the step 218 activity indication indicates an active state (i.e. an active activity indication), proceeding to step 222. Step 222 comprises generating a negative EoS state indication 14 and the end of method 201.

If the step 218 activity indication indicates an idle state (i.e. an idle activity indication), method 201 proceeds to step 224 which involves determining the data health of wellsite stage data 12B. Step 224 may comprise generating a stage data health indication, wherein the stage data health indication indicates the health of wellsite stage data 12B. A particular embodiment of the step 224 wellsite stage data health check is described in more detail below.

Method 201 then proceeds to step 226 which comprises: querying the step 224 stage data health indication; and if the step 224 stage data health indication indicates unhealthy wellsite stage data 12B (i.e. a negative stage data health indication), proceeding to step 216.

If the step 224 stage data health indication indicates healthy data (i.e. a positive stage data health indication), method 201 proceeds to step 228 which involves determining an end-of-stage of wellsite 100 from the wellsite stage data 12B.

If step 228 determines an end-of-stage, method 201 proceeds to step 230 generating a positive EoS state indication 14 and the end of method 201. If step 228 determines not an end-of-stage, method 201 proceeds to step 222 which, as discussed above, involves generating a negative EoS state indication 14 and the end of method 201.

Figure 3A:
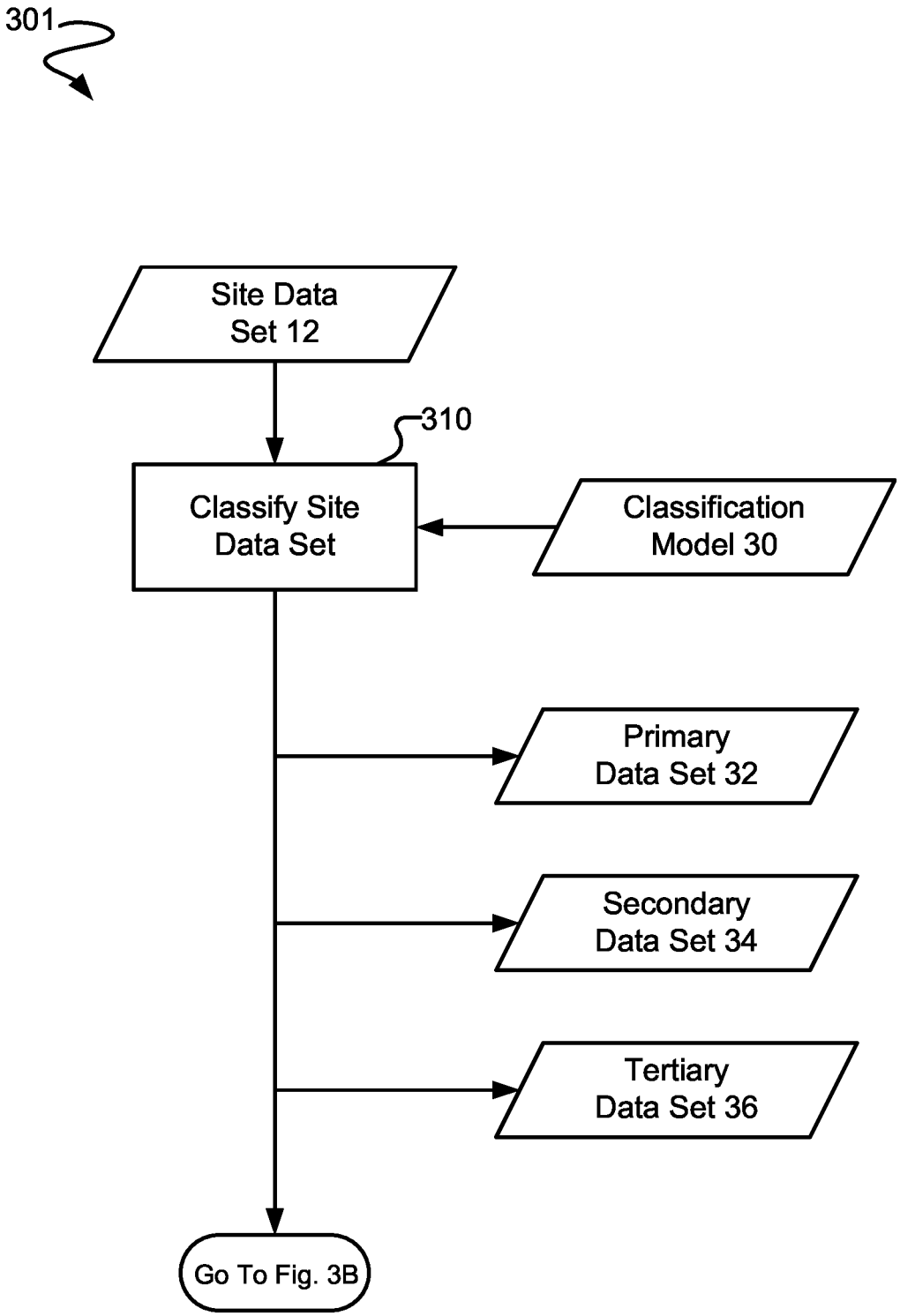
FIGS. 3A to 3C depict an example embodiment of a method for performing a wellsite activity data health check.
Figure 3B:
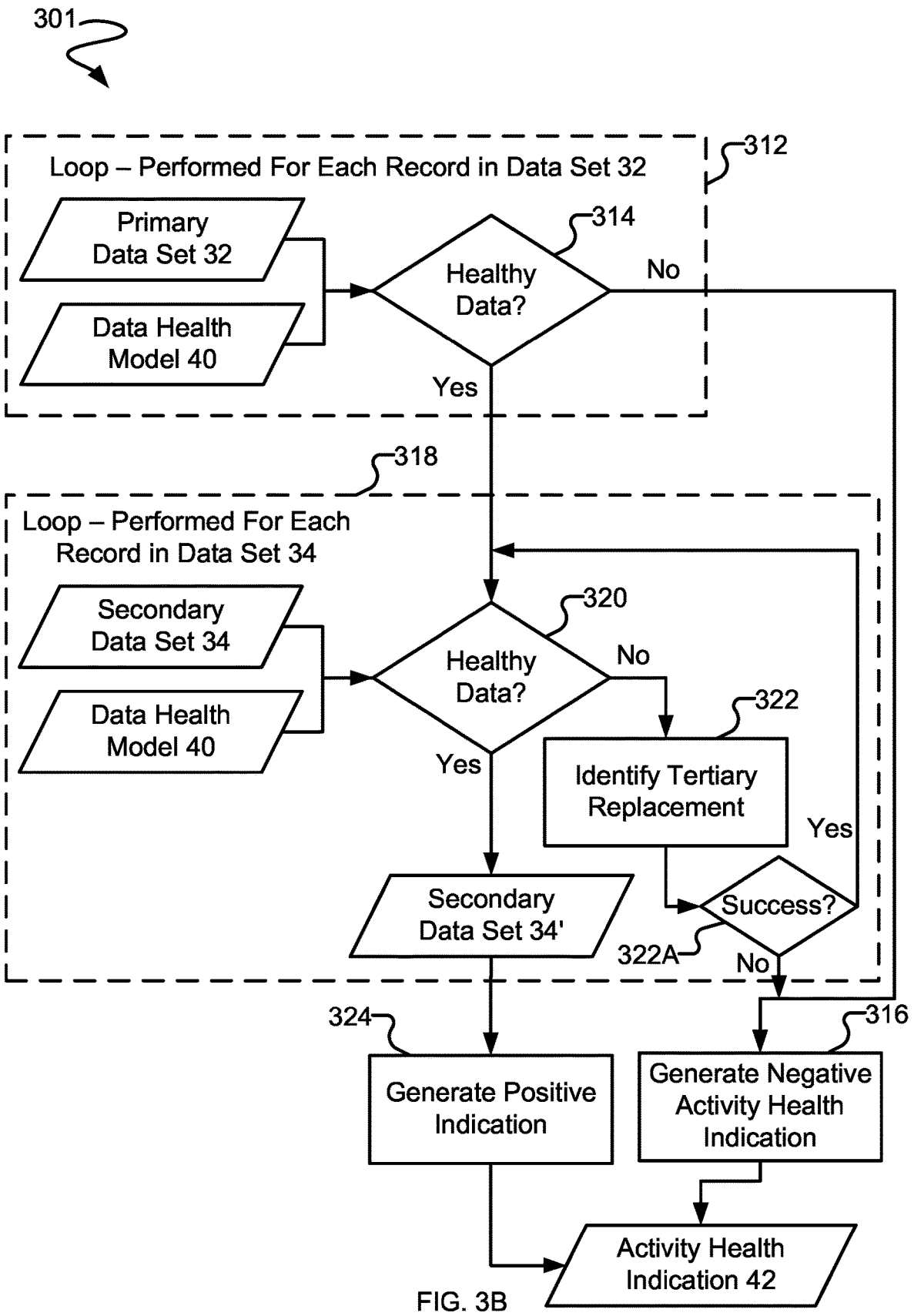
Figure 3C:
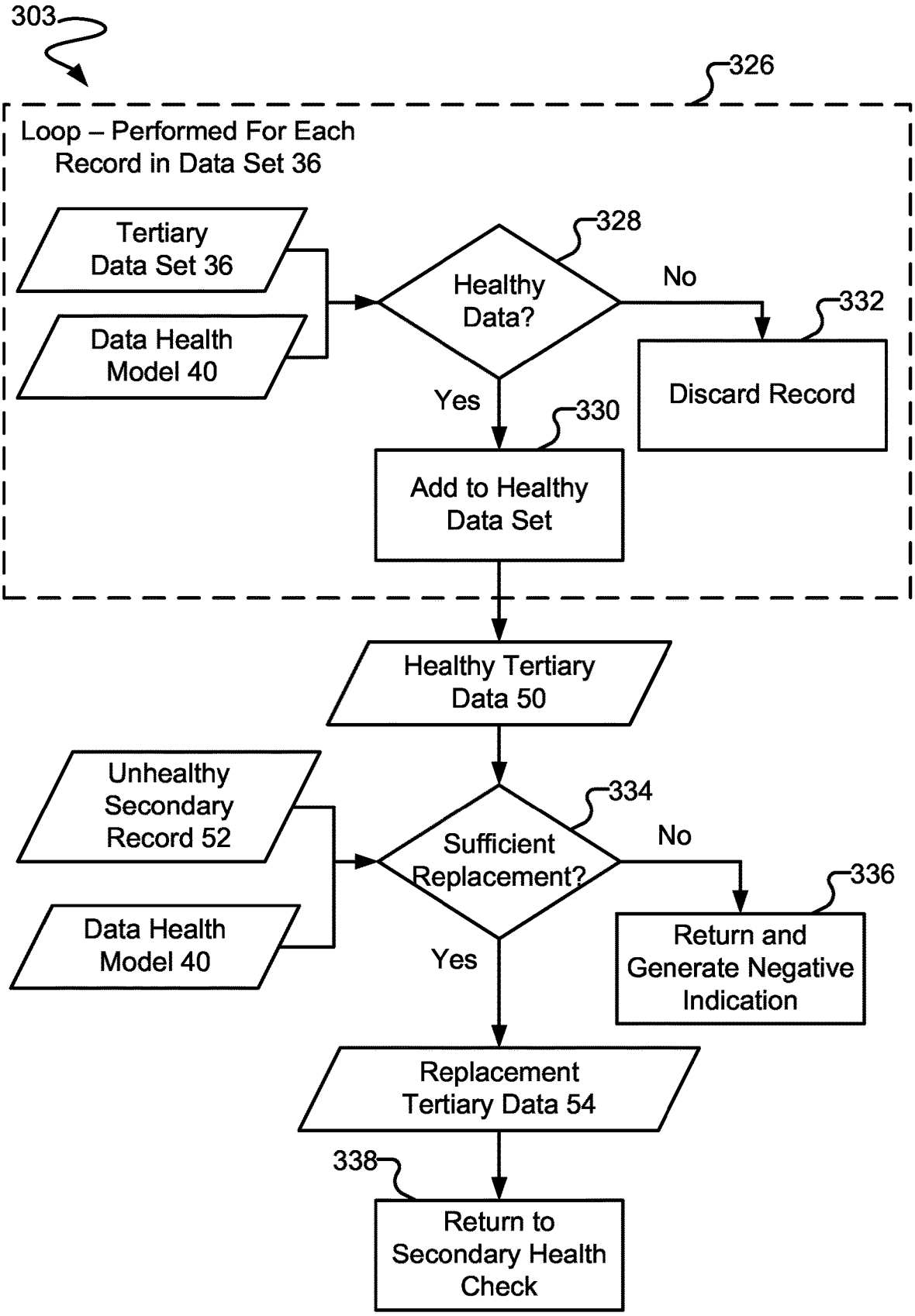

FIGS. 3A to 3C depict an example embodiment method 301 for performing a wellsite activity data health check. In some embodiments, method 301 may be performed by step 212 of method 201.

Method 301 comprises step 310 which involves classifying wellsite activity data 12A with classification model 30. In some embodiments, wellsite activity data 12A comprises a set of data records, wherein each data record has a data type. Classification model 30 may comprise a lookup table storing pairs of data types and one of three data classifications: primary, secondary and tertiary.

Step 310 may comprise classifying the data records in wellsite activity data 12A into three data sets:

- primary data set 32 containing all of the data records in wellsite activity data 12A with a data type corresponding to the primary classification;
- secondary data set 34 containing all of the data records in wellsite activity data 12A with a data type corresponding to the secondary classification; and
- tertiary data set 36 containing all of the data records in wellsite activity data 12A with a data type corresponding to the tertiary classification.

Method 301 then enters loop 312 (FIG. 3B), which comprises step 314 which involves checking the health of each of the data records in primary data set 32. Step 314 determines the health of each data record in primary data set 32 according to data health model 40.

Data health model 40 comprises one or more rules for determining the health of a data record. For example, data health model 40 may comprise one or more of the following rules:

- one or more rules for determining an age of a data record and determining whether or not the data record is healthy depending on the age of the data record; and
- one or more rules defining expected ranges for one or more elements of a data record and determining whether or not a data record is healthy if the one or more elements of the data record is/are within the expected ranges.

In some embodiments, healthy data may comprise data less than five seconds old and comprising at least one billion data points.

Each rule of data health model 40 may be applicable to one or more data types or one or more classifications, or applicable to all data records.

If the health determination for any one of the data records in primary data set 32 indicates an unhealthy data record, then method 301 proceeds to step 316 which involves generating a negative activity health indication 42. If all of the health determinations for all of the data records in primary data set 32 indicate healthy data records, then method 301 proceeds to loop 318.

Loop 318 comprises step 320 which involves checking the health of each of the data records in secondary data set 34, and optional step 322 which involves identifying a tertiary data replacement.

Similar to step 314, step 320 comprises determining the health of each data record in secondary data set 34 according to data health model 40. As described above, data health model 40 comprises one or more rules for determining the health of a data record.

If the step 320 data health determination for any one of the data records in secondary data set 34 is unhealthy, then method 301 proceeds to step 322 which involves identifying a tertiary data replacement. If step 322 is successful (step 322A YES branch), then loop 318 continues to run for the remaining records in secondary data set 34. If either step 320 or step 322 is successful for each of the data records in secondary data set 34, then method 301 proceeds to step 324, which involves generating a positive activity health indication 42.

If steps step 320 and step 322 are unsuccessful for any one record in secondary data set 34 (step 322A NO branch), then method 301 proceeds to step 316, generating a negative health indication 42.

FIG. 3C depicts an example embodiment of method 303 for identifying a tertiary data replacement. In some embodiments, method 303 may be performed by step 322 in method 301.

Method 303 begins with loop 326, which comprises step 328 which involves checking the health of each of the data records in tertiary data set 36 to generate healthy tertiary data set 50. Similar to step 314, step 328 comprises determining the health of each data record in tertiary data set 36 according to data health model 40. As described above, data health model 40 comprises one or more rules for determining the health of a data record.

Step 328 ascertains the health of each record in tertiary data set 36, and, for each healthy record, method 303 proceeds to step 330 which involves adding the record to healthy tertiary data set 50. For each unhealthy record ascertained in step 328, method 303 proceeds to step 332 which involves discarding the unhealthy record. Once loop 328 is performed for each record in tertiary data set 36, method 303 proceeds to step 334.

Loop 326 need be performed only once for a given tertiary data set 36. If method 303 is performed a subsequent time for the same tertiary data set 36, method 303 may proceed directly to step 334 as healthy tertiary data set 50 will already have been generated in a previous iteration.

Step 334 comprises identifying a sufficient tertiary data replacement for an unhealthy secondary record 52 according to data health model 40. Unhealthy secondary record 52 is the secondary record for which step 320 (FIG. 3B) determined an unhealthy data health. Data health model 40 comprises one or more rules for identifying a tertiary data replacement for an unhealthy secondary record 52. For example, data health model 40 may comprise one or more of the following rules:

- each unhealthy secondary record 52 may be replaced by a distinct healthy tertiary data record; and
- an unhealthy secondary record 52 of a first data type may be replaced by a healthy tertiary data record of a second data type.

If step 334 is unsuccessful for unhealthy secondary record 52, then method 303 proceeds to step 336 which involves returning to loop 318 (FIG. 3B) and proceeding to step 316 which involves generating negative activity health indication 42.

If step 334 is successful for unhealthy secondary record 52, step 334 then comprises adding the identified replacement tertiary data to replacement tertiary data set 54, after-which method 303 proceeds to step 338. Step 338 comprises returning to loop 318, a positive success inquiry in step 3222A and returning to step 320 for the next record in secondary data set 34.

Figure 4:
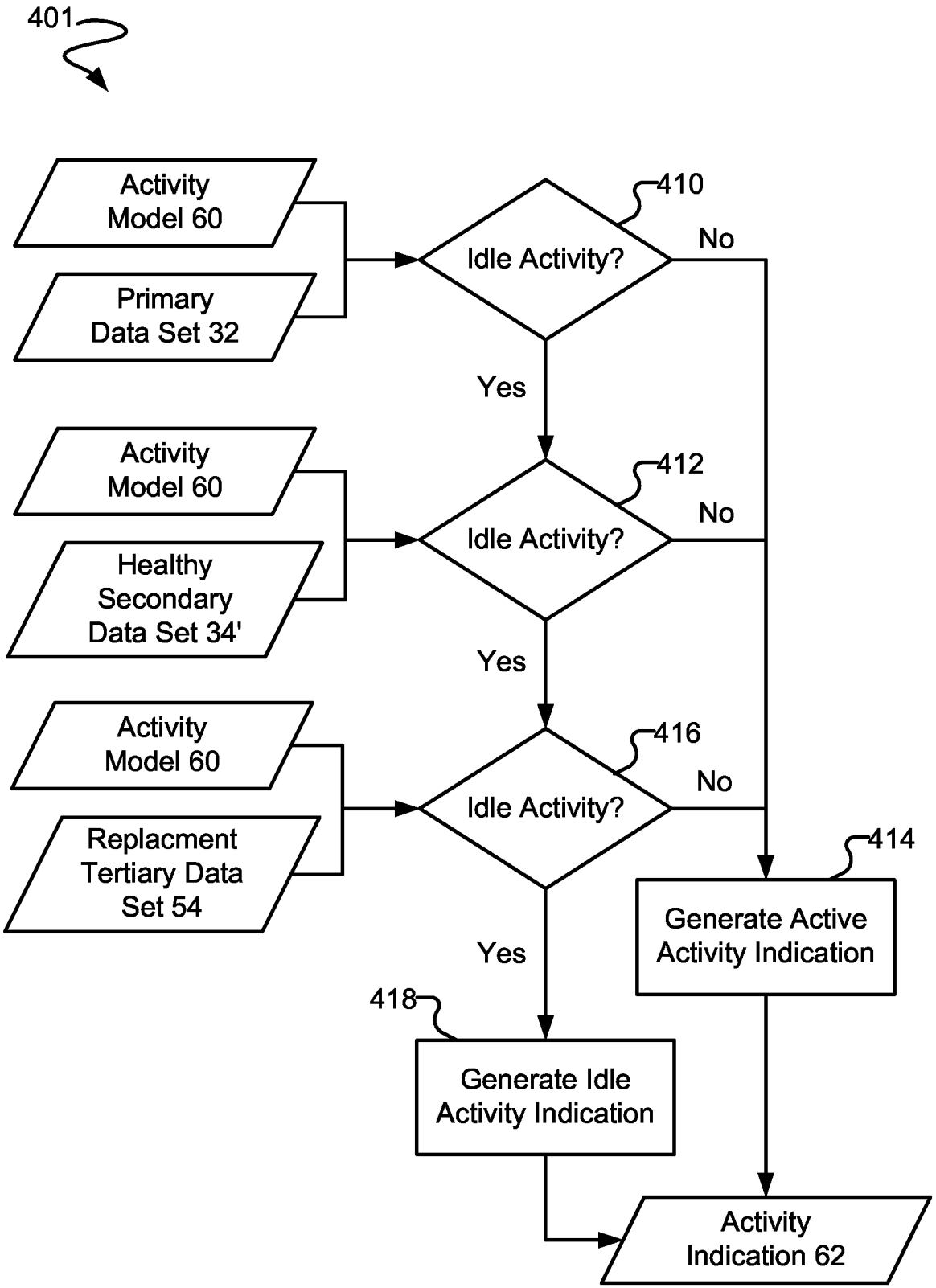
FIG. 4 depicts an example embodiment of a method for determining a wellsite activity indication.

FIG. 4 depicts an example embodiment of method 401 for determining a wellsite activity indication 62. In some embodiments, method 401 may be performed by step 220 of method 201.

Method 401 starts in step 410 which comprises determining an activity status of primary data set 32 (FIG. 3A) using activity model 60. Activity model 60 comprises one or more rules for determining an activity status of each data record in primary data set 32. For example, activity model 60 may comprise one or more of the following rules:

a data range that indicates an idle state; and a data range that indicates an active state.

If step 410 determines an idle activity status for each data record in primary data set 32, then method 401 proceeds to step 412. If step 410 determines an active activity status for any record in primary data set 32, then method 401 proceeds to step 414 which involves generating an active activity indication 62.

Step 412 comprises determining an activity status of healthy secondary data set 34' using activity model 60. Healthy secondary data set 34' may comprise all of the records in secondary data set 34 for which step 320 (FIG. 3B) determined a healthy data health.

If step 412 determines an idle activity status for each data record in healthy secondary data set 34', then method 401 proceeds to step 416. If step 412 determines an active activity status for any record in healthy secondary data set 34', then method 401 proceeds to step 414 which involves generating an active activity indication 62.

Step 416 comprises determining an activity status of replacement tertiary data set 54 using activity model 60. As discussed above, replacement tertiary data set 54 may comprise the set of replacement tertiary data determined by step 334 (FIG. 3C) to be viable replacement data for an unhealthy element of secondary data set 34. If step 416 determines an idle activity status for each data record in replacement tertiary data set 54, then method 401 proceeds to step 418 generating an idle activity indication 62. If step 416 determines an active activity status for any record in replacement tertiary data set 54, then method 401 proceeds to step 414 which involves generating an active activity indication 62.

Figure 5:
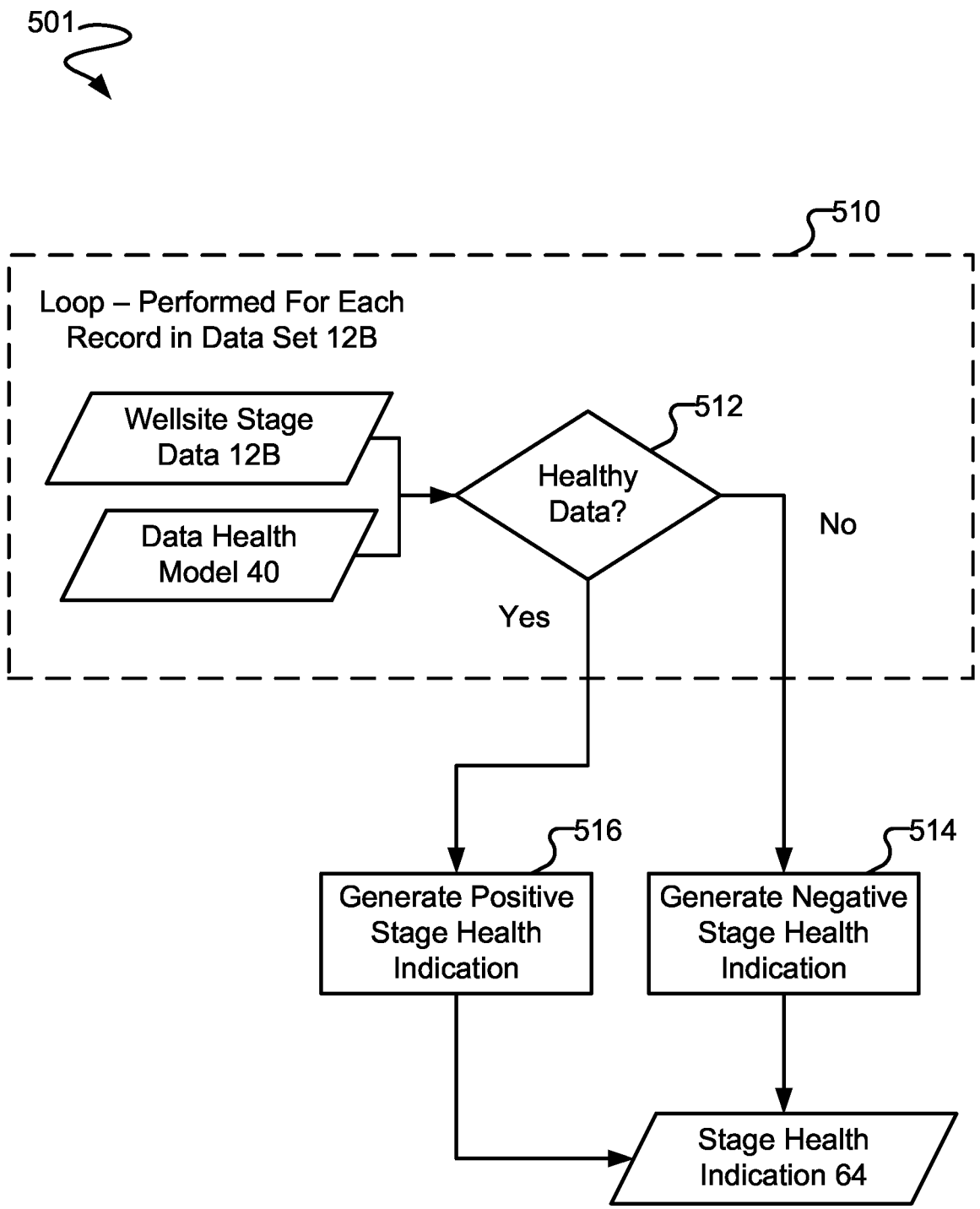
FIG. 5 depicts an example embodiment of a method for determining a data health of wellsite stage data.

FIG. 5 depicts an example embodiment of method 501 for determining a data health of wellsite stage data 12B. In some embodiments, method 501 may be performed by step 224 (FIG. 2B) of method 201.

Method 501 comprises preforming loop 510 for each data record in wellsite stage data 12B. Loop 510 comprises determining a data health of each data record in wellsite stage data 12B according to data health model 40, as described above.

If step 512 determines an unhealthy data health for greater than or equal to a configurable threshold number of records in wellsite stage data 12B, then loop 510 terminates and method 501 proceeds to step 514, which involves generating a negative stage health indication 64. The threshold number of unhealthy wellsite stage data records may be stored in or determined by data health model 40. The threshold number of unhealthy records may be one.

If step 512 determines a healthy data health for a requisite number (or more) of records in wellsite stage data 12B, then loop 510 terminates and method 501 proceeds to step 516, which involves generating a positive stage health indication 64. The requisite number of healthy wellsite stage data records may be stored in or determined by data health model 40. The threshold number of healthy wellsite stage data records may be equal to the number of records in wellsite stage data 12B.

Figure 6A:
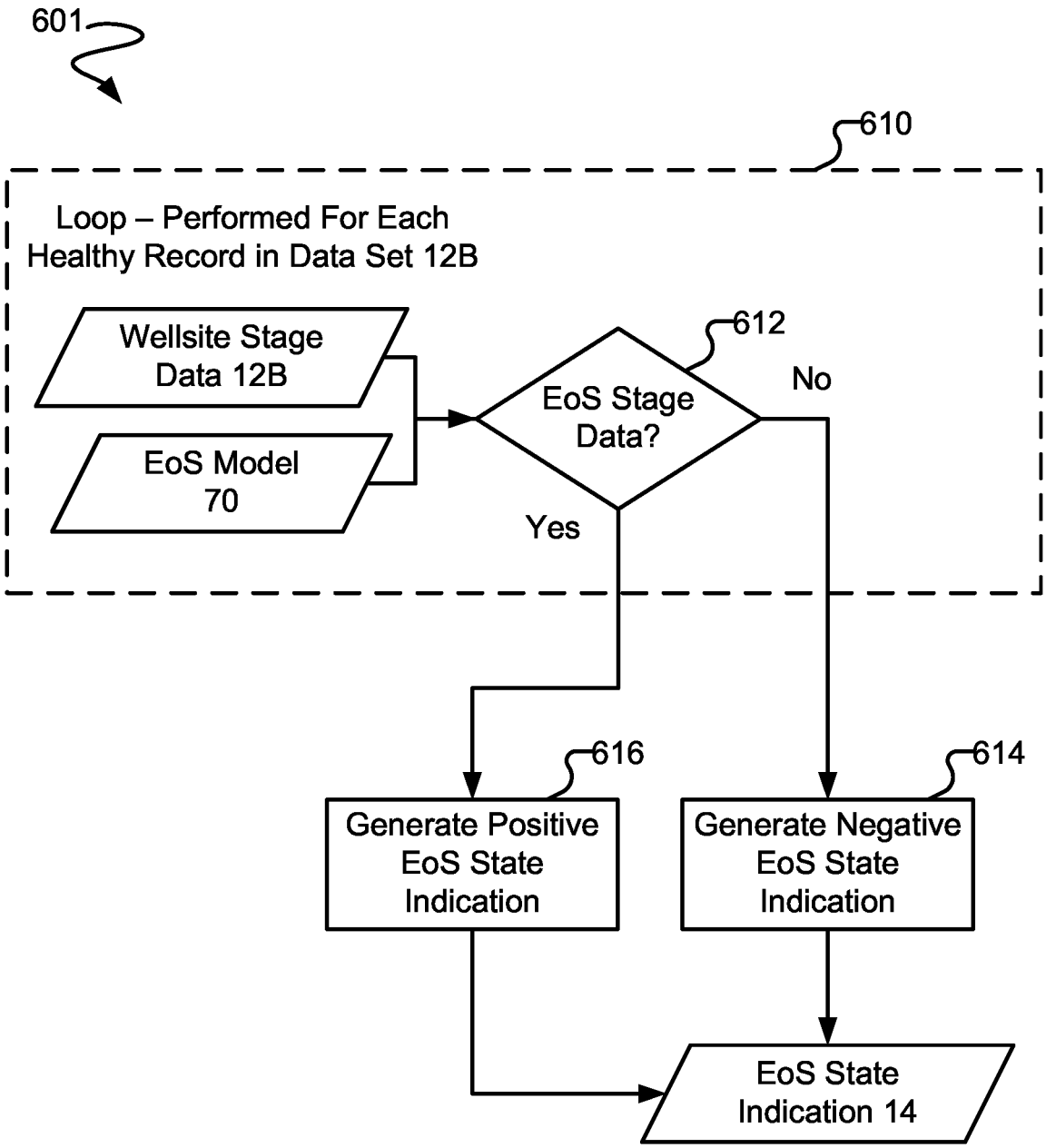
FIG. 6A depicts an example embodiment of a method for determining an end of stage indication.

FIG. 6A depicts an example embodiment of method 601 for determining an end of stage indication. In some embodiments, method 601 is performed by step 228 (FIG. 2B) in method 201.

Method 601 comprises performing loop 610 for each healthy data record in wellsite stage data 12B. In embodiments where the threshold number of unhealthy wellsite stage data records is one, loop 610 is performed for each data record in wellsite stage data 12B.

Loop 610 comprises step 612, which involves determining if each healthy record in data set 12B indicates an end-of-stage according to EoS model 70. EoS model 70 comprises one or more rules for determining an EoS state of each healthy data record in data set 12B. For example, EoS model 70 may comprise one or more of the following rules:

minimum levels of fracking water;

minimum levels of fracking proppant;

minimum levels of fracking additives; and thresholds differences between actual and minimum levels.

If step 612 determines a positive EoS state for greater than or equal to a configurable threshold number of records in wellsite stage data 12B, then loop 610 terminates and method 601 proceeds to step 616, which involves generating a positive EoS state indication 12. The threshold number of records required for a positive EoS determination may be stored in or determined by EoS model 70. The threshold number of records required for a positive EoS state determination may be equal to the total number of healthy records in wellsite stage data 12B and/or the total number of records in wellsite stage data 12B.

If step 612 determines a negative EoS state for greater than or equal to a configurable threshold number of records in wellsite stage data 12B, then loop 610 terminates and method 601 proceeds to step 614, which involves generating a negative EoS state indication 12. The threshold number of records required for a negative EoS state determination may be stored in or determined by EoS model 70. The threshold number of records required for a negative EoS state determination may be equal to one.

Figure 6B:
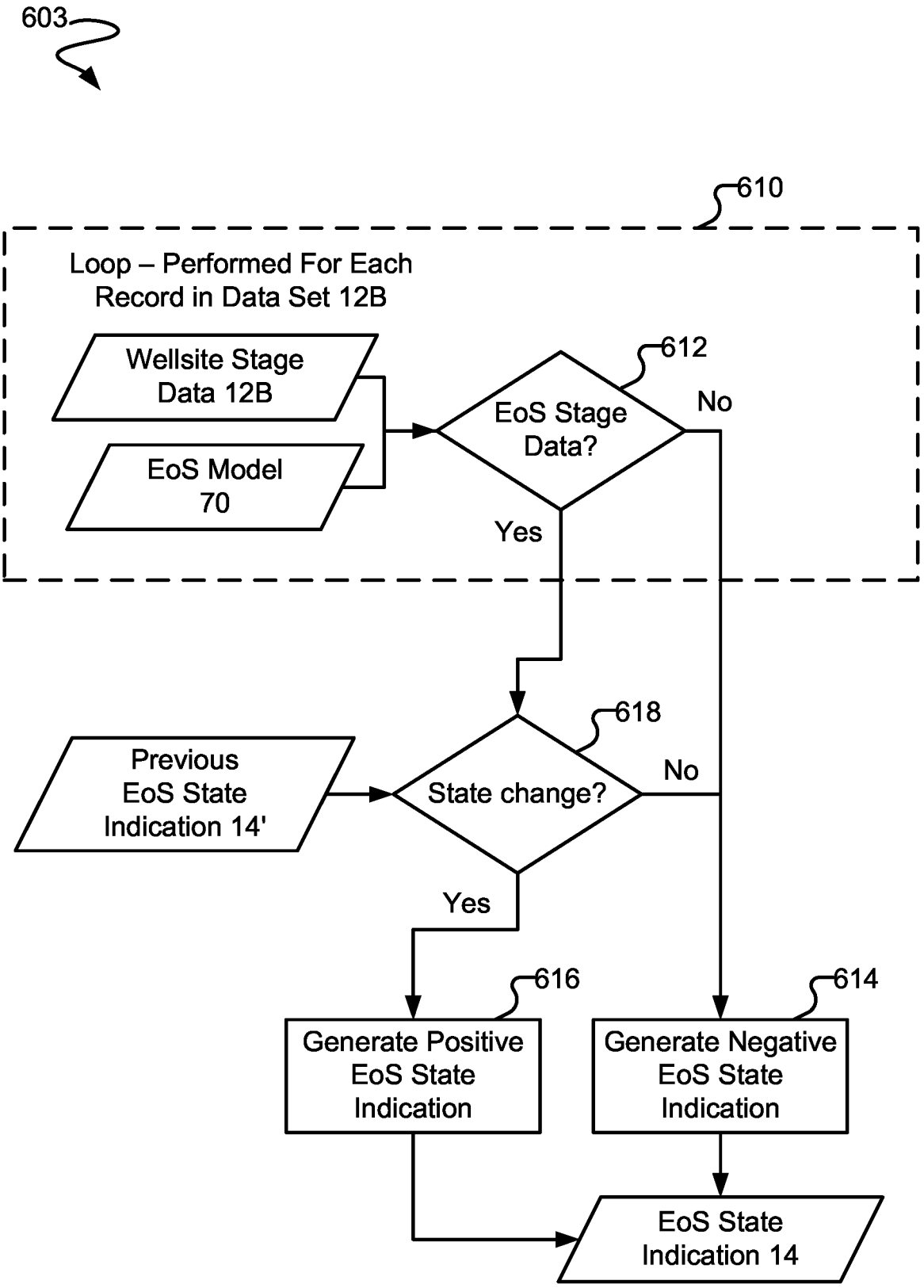
FIG. 6B depicts another example embodiment of a method for determining an end of stage indication.

FIG. 6B depicts another example embodiment of a method 603 for determining an end of stage indication. In some embodiments, method 603 is performed by step 228 (FIG. 2B) in method 201. Method 603 comprises loop 610 and steps 612, 614 and 616 as described above. Method 603 further comprises step 618, which involves determining a change in EoS state.

Step 618 may be performed once step 612 determines a positive EoS state for a threshold number of records in wellsite stage data 12B and loop 610 terminates, and before step 616. Step 618 comprises determining the state of a previous EoS state indication 14'. Previous EoS state indication 14' may be the EoS state indication determined by a previous performance of method 201.

If previous EoS state indication 14' is negative, meaning that method 201 previously determined that wellsite 100 is not in an EoS state, then method 603 proceeds to step 616, generating a positive EoS state indication. If previous EoS state indication 14' is positive, meaning that method 201 previously determined that wellsite 100 is in an EoS state, then method 603 proceeds to step 614, generating a negative EoS state indication.

Method 603 may be used to indicate a start of a new end of stage of wellsite 100, as a positive EoS state indication 14 is generated only once per EoS determination (on the iteration of step 228 when the EoS state changes state from negative to positive).

Figure 7:
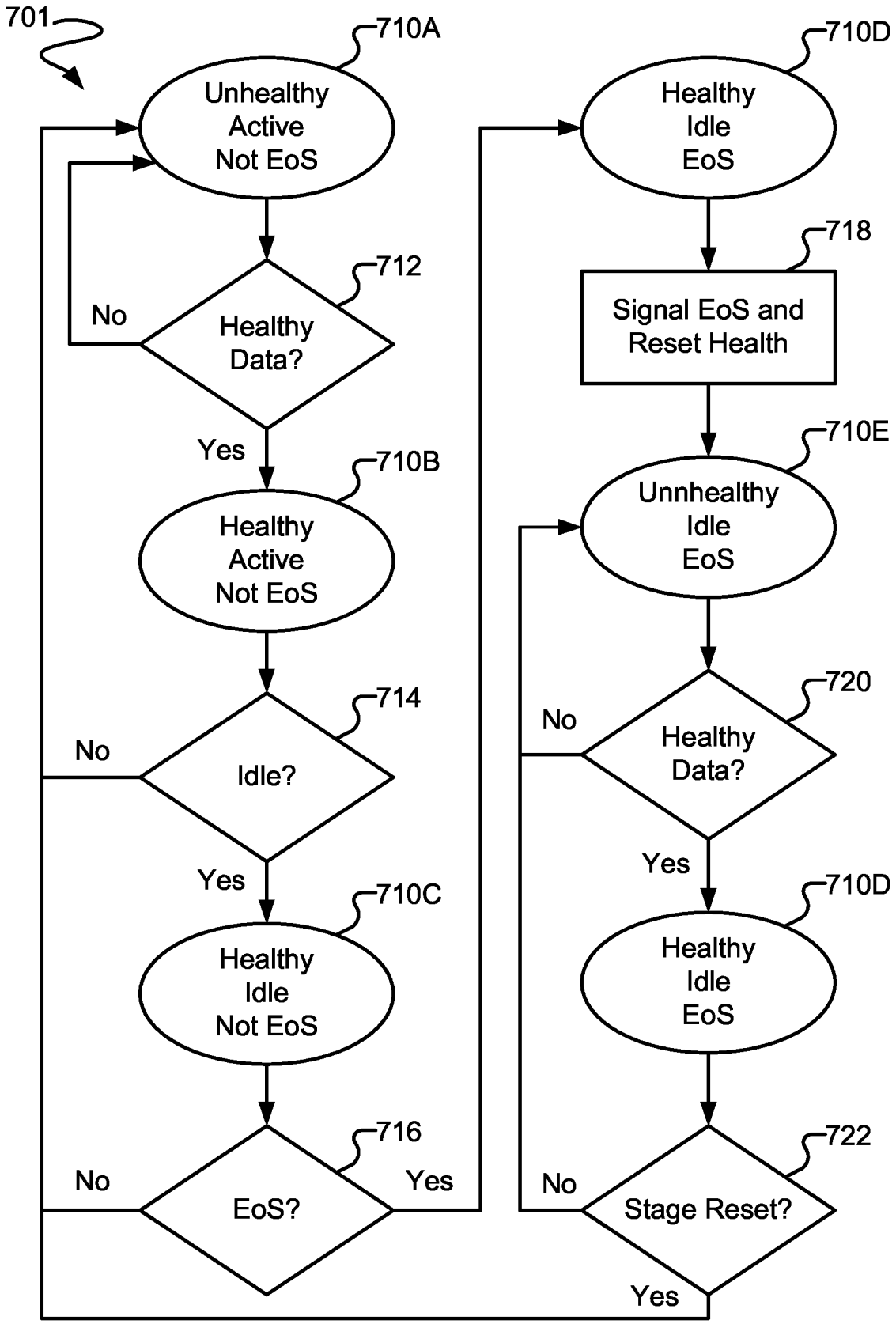
FIG. 7 is a schematic diagram of an example embodiment of a state machine for signaling an end of stage (EoS).

FIG. 7 is a schematic diagram of an example embodiment of a state machine 701 for signaling an end of stage (EoS). State machine 701, which may be effected by suitable programming of processor 204 for example, may determine a state 710 of wellsite 100 from wellsite data set 12.

Wellsite state 710 represents a state of wellsite 100. Wellsite state 710 comprises three sub-states: a data health state, an activity state, and an end-of-stage (EoS) state. Each of these sub-states may be binary and, accordingly, wellsite state 710 may have one of eight states:

| Data Health State | Activity State | EoS State | Wellsite State |
|---|---|---|---|
| Unhealthy | Active | Not EoS | 710A |
| Healthy | Active | Not EoS | 710B |
| Unhealthy | Idle | Not EoS | Unused |
| Healthy | Idle | Not EoS | 710C |
| Unhealthy | Active | EoS | Unused |
| Healthy | Active | EoS | Unused |
| Unhealthy | Idle | EoS | 710E |
| Healthy | Idle | EoS | 710D, 710F |

State machine 701 is initiated in state 710A representing unhealthy data, active activity, and not EoS, of wellsite 100. State machine 701 may be initiated in state 710A to ensure that an EoS is not determined and/or signaled unless healthy wellsite data indicates an idle state and an EoS. Such an initial state may support a "fail safe" methodology, where wellsite 100 is presumed active and not in an EoS state unless proven otherwise by healthy wellsite data.

State machine 701 commences with step 712, retrieving wellsite data 12 and determining a wellsite data health. Step 712 may comprise performing methods 301 and/or 303 described above.

If step 712 determines healthy wellsite data, then wellsite state 710 changes to state 7106 (healthy data, active activity, not EoS) and proceeds to step 714. If step 712 determines unhealthy wellsite data, then wellsite state 710 maintains state 710A and state machine 701 returns to step 712. State machine 701 will maintain state 710A and periodically perform step 712 until the outcome of step 712 determines healthy wellsite data.

Step 714 comprises determining an activity state of wellsite 100 from wellsite data 12. Step 714 may comprise performing method 410 described above.

If step 714 determines an idle state, then wellsite state 710 changes to state 710C (healthy data, idle activity, not EoS) and proceeds to step 716. If step 714 determines an active state, then wellsite state 710 changes to state 710A and state machine 701 returns to step 712.

Step 716 comprises determining an EoS state of wellsite 100 from wellsite data 12. Step 716 may comprise performing method 601 described above.

If step 716 determines an EoS state, then wellsite state 710 changes to state 710D (healthy data, idle activity, EoS) and proceeds to step 718. If step 716 determines a not EoS state, then wellsite state 710 changes to state 710A and state machine 701 returns to step 712.

Step 718 comprises signaling an EoS. In some embodiments, signaling an EoS may comprise transmitting an EoS state indication to another system, for example a system of wellsite 100, such as switchover valve controller 122.

Switchover valve controller 122 may be configured to operate switchover valve 114 in response to receiving an EoS state indication or signal. For example, switchover valve controller 122 may comprise, or access, a fracking list for wells 110 and may be configured to operate switchover valve 114 to direct pumps 112 to a subsequent one of wells 110 in the fracking list.

Step 718 further comprises changing wellsite state 710 to state 710E (unhealthy data, idle activity, EoS), whereupon step 720 is performed.

Step 720 comprises retrieving wellsite data and determining a wellsite data health. Step 720 may comprise performing method 501 described above.

If step 720 determines healthy wellsite data, then wellsite state 710 changes to state 710D (healthy data, idle activity, EoS) and proceeds to step 722. If step 720 determines unhealthy wellsite data, then wellsite state 710 maintains state 710E and state machine 701 returns to step 720. State machine 701 will maintain state 710E and periodically perform step 720 until step 720 determines healthy wellsite data.

Step 722 comprises determining a stage reset of wellsite 100. Once a fracking stage has ended, the reservoirs of fracking materials (water, proppant, additives) are refilled. Step 722 may comprise checking wellsite data 12 to determine when the reservoir levels of the fracking materials has increased to greater than or equal to a threshold amount, thereby indicating that a new fracking stage has commenced or will be commencing.

If step 722 determines a stage reset, then wellsite state 710 changes to state 710A (unhealthy data, active activity, not EoS) and proceeds to step 712. If step 722 does not determine a stage reset, then wellsite state 710 changes to state 710E (unhealthy data, idle activity, EoS) and state machine 701 returns to step 720.

Some Embodiments

One or more embodiments of the present invention may comprise one or more of:

- a computer system configured to perform one or more of the methods disclosed herein; and
- a computer readable memory storing machine-readable instructions that when performed by a computer system cause the computer system to perform one or more of the methods disclosed herein.

One or more embodiments of the present invention are described as comprising one or more models. As used herein, a model may comprise any combination of computer hardware and computer software configured to provide the described functionality. For example, a model may comprise:

- a sequence of computer instructions;
- a look up table; and
- a trained machine learning algorithm.

Interpretation of Terms

Unless the context clearly requires otherwise, throughout the description and the

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs")). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a control circuit for a device may implement methods as described herein by executing software instructions in a program memory accessible to the processors.

Processing may be centralized or distributed. Where processing is distributed, information including software and/or data may be kept centrally or distributed. Such information may be exchanged between different functional units by way of a communications network, such as a Local Area Network (LAN), Wide Area Network (WAN), or the Internet, wired or wireless data links, electromagnetic signals, or other data communication channel.

For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Software and other modules may reside on servers, workstations, personal computers, tablet computers, image data encoders, image data decoders, PDAs, color-grading tools, video projectors, audio-visual receivers, displays (such as televisions), digital cinema projectors, media players, and other devices suitable for the purposes described herein. Those skilled in the relevant art will appreciate that aspects of the system can be practised with other communications, data processing, or computer system configurations, including: Internet appliances, hand-held devices (including personal digital assistants (PDAs)), wearable computers, all manner of cellular or mobile phones, multi-processor systems, microprocessor-based or programmable consumer electronics (e.g., video projectors, audio-visual receivers, displays, such as televisions, and the like), set-top boxes, color-grading tools, network PCs, mini-computers, mainframe computers, and the like.

The invention may also be provided in the form of a program product. The program product may comprise any non-transitory medium which carries a set of computer-readable instructions which, when executed by a data processor, cause the data processor to execute a method of the invention. Program products according to the invention may be in any of a wide variety of forms. The program product may comprise, for example, non-transitory media such as magnetic data storage media including floppy diskettes, hard disk drives, optical data storage media including CD ROMs, DVDs, electronic data storage media including ROMs, flash RAM, EPROMs, hardwired or preprogrammed chips (e.g., EEPROM semiconductor chips), nanotechnology memory, or the like. The computer-readable signals on the program product may optionally be compressed or encrypted.

In some embodiments, the invention may be implemented in software. For greater clarity, "software" includes any instructions executed on a processor, and may include (but is not limited to) firmware, resident software, microcode, and the like. Both processing hardware and software may be centralized or distributed (or a combination thereof), in whole or in part, as known to those skilled in the art. For example, software and other modules may be accessible via local memory, via a network, via a browser or other application in a distributed computing context, or via other means suitable for the purposes described above.

Where a component (e.g. a model, a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

The invention claimed is:

1. A method for automatically determining an end-of-stage (EoS) state indication of a fracking operation occurring at a fracking site and effecting switching of a switchover valve between fracking wells, the method comprising:

receiving, at a processor, an end-of-stage (EoS) detection model;

receiving, at the processor, wellsite activity data comprising a plurality of activity records relating to activities taking place at the fracking site;

receiving, at the processor, wellsite stage data comprising a plurality of stage records relating to a fracking stage of the fracking site;

wherein the EoS detection model comprises:

an activity classification model which relates each of a plurality of types of wellsite activity data to a corresponding one of a plurality of data classifications;

an activity health model which comprises one or more rules for determining a health of a record from among the plurality of activity records of the wellsite activity data based on at least one of: an age of the data record; and a range of elements in the data record;

an activity model comprising one or more rules for determining an activity status of a record from among the plurality of activity records of the wellsite activity data to indicate an idle state or an active state based on the range of elements in the data record;

a stage health model which comprises one or more rules for determining a health of a record from among the plurality of stage records of the wellsite stage data based on at least one of: an age of the data record; and a range of elements in the data record;

a EoS model which comprises one or more rules for determining whether a record from among the plurality of stage records of the wellsite stage data indicates an end-of-stage based on at least one of: minimum levels of fracking water; minimum levels of fracking proppant; minimum levels of fracking additives; and threshold differences between actual levels and minimum levels of fracking water, fracking proppant and/or fracking additives;

automatically determining, by the processor, a positive activity data health indication in relation to the wellsite activity data wherein determining the positive activity data health indication comprises:

automatically classifying, by the processor, each record from among the plurality of activity records of the wellsite activity data into one of the plurality of data classifications using the activity classification model; and for each of the plurality of data classifications, automatically determining, by the processor, a positive activity health by applying, by the processor, the one or more rules of the activity health model to the records in the data classification;

automatically determining, by the processor, an idle activity indication from the wellsite activity data by, for each of the plurality of data classifications, applying, by the processor, the one or more rules of the activity model to the records in the data classification;

automatically determining, by the processor, a positive stage data health indication in relation to the wellsite stage data by applying, by the processor, the one or more rules of the stage health model to the plurality of stage records in the wellsite stage data;

automatically determining, by the processor, a positive EoS state indication from the wellsite stage data by applying, by the processor, the one or more rules of the EoS model to the plurality of stage records in the wellsite stage data; and communicating, by the processor, the positive EOS state indication to a switchover valve controller, the positive EOS state indication instructing the switchover valve controller to switch a switchover valve from a first fracking well to a second fracking well.

2. The method according to claim 1 wherein:

determining the positive activity data health indication comprises:

classifying each record from among the plurality of activity records as a primary record, a secondary record, or a tertiary record using the activity classification model;

determining a positive activity health of each of the primary records using the activity health model; and determining a positive activity health of each of the secondary records using the activity health model.

3. The method according to claim 1 wherein:

determining the positive activity data health indication comprises:

classifying each record from among the plurality of activity records as a primary record, a secondary record, or a tertiary record using the activity classification model;

determining a positive activity health of each of the primary records using the activity health model;

determining a negative activity health of at least one of the secondary records using the activity health model;

determining a positive activity health of at least one of the tertiary records using the activity health model; and for each of the secondary records with a determined negative activity health, determining one or more replacement tertiary records with a positive activity health using the activity health model.

4. The method according to claim 2 wherein:

determining the idle activity indication comprises:

for each of the primary records, determining an idle activity using the activity model; and for each of the secondary records determined by the activity health model to have positive activity health, determining an idle activity using the activity model.

5. The method according to claim 3 wherein:

determining the idle activity indication comprises:

for each of the primary records, determining an idle activity using the activity model;

for each of the secondary records determined by the activity health model to have positive activity health, determining an idle activity using the activity model; and for any replacement tertiary records, determining an idle activity using the activity model.

6. A system for operating a fracking site switchover valve, the system comprising:

a switchover valve controller; and a computer system communicatively coupled to the switchover valve controller, wherein the computer system is configured to:

determine an end-of-stage (EoS) indication and effect switching of a switchover valve between fracking wells according to the method of claim 1.

* * * * *